US006326330B1

(12) United States Patent
Wagner et al.

(10) Patent No.: US 6,326,330 B1
(45) Date of Patent: Dec. 4, 2001

(54) THERMO-SENSITIVE PRINTING SHEET COMPRISING A BACK COATING CONTAINING STARCH, AN ACRYLATE COPOLYMER AND AN ALKALINE CATALYST

(75) Inventors: Wolfgang Wagner, Flensburg; Jutta Berndt, Jarplund; Franz Wirnitzer, Flensburg, all of (DE)

(73) Assignee: Mitsubishi Hitech Paper Flensburg GmbH, Flensburg (DE)

( * ) Notice: Subject to any disclaimer, the term of this patent is extended or adjusted under 35 U.S.C. 154(b) by 0 days.

(21) Appl. No.: 09/297,987

(22) PCT Filed: Aug. 22, 1998

(86) PCT No.: PCT/EP98/05347

§ 371 Date: May 11, 1999

§ 102(e) Date: May 11, 1999

(87) PCT Pub. No.: WO99/14056

PCT Pub. Date: Mar. 25, 1999

(30) Foreign Application Priority Data

Sep. 12, 1997 (DE) ..... 197 40 072
Oct. 31, 1997 (DE) ..... 197 48 258

(51) Int. Cl.[7] ..... B41M 5/40
(52) U.S. Cl. ..... 503/200; 503/226
(58) Field of Search ..... 427/152; 503/200, 503/226

(56) References Cited

U.S. PATENT DOCUMENTS

| | | | |
|---|---|---|---|
| 4,424,245 | 1/1984 | Maruta et al. | 428/40 |
| 4,593,298 | 6/1986 | Ikeda et al. | 346/200 |
| 4,711,874 | 12/1987 | Yuyama et al. | 503/206 |
| 4,837,196 | 6/1989 | Ogata | 503/200 |
| 4,855,277 | 8/1989 | Walter | 503/204 |
| 5,068,133 | 11/1991 | Matsumoto et al. | 427/358 |

FOREIGN PATENT DOCUMENTS

| | | | |
|---|---|---|---|
| 38 06 201 | 9/1988 | (DE) . | |
| 32 07 071 | 9/1982 | (DE) | B41M/5/18 |
| 3529781 | 2/1986 | (DE) | B41M/5/18 |
| 37 20 171 | 2/1988 | (DE) | B41M/5/18 |
| 38 36 660 | 8/1991 | (DE) | B41M/5/26 |
| 0 602 494 | 12/1993 | (EP) | B41M/5/00 |
| 0 171 810 | 8/1985 | (EP) | B41M/5/26 |
| 0 518 552 | 6/1992 | (EP) | B41M/5/40 |
| 58-199189 | 11/1983 | (JP) | B41M/5/18 |
| 60-2397 | 1/1985 | (JP) | B41M/5/18 |

*Primary Examiner*—Bruce H. Hess
(74) *Attorney, Agent, or Firm*—Cohen, Pontani, Lieberman & Pavane

(57) ABSTRACT

A heat-sensitive recording sheet has A heat-sensitive recording layer containing color formers and color developers formed on one side of a substrate, a backcoat is formed on the side opposite to the recording layer, wherein this backcoat is formed of A mixture containing starch, an acrylate copolymer which does not comprise styrene or vinyl acetate components and has a film-forming temperature of less than 5° C., and an alkaline catalyst.

14 Claims, No Drawings

THERMO-SENSITIVE PRINTING SHEET COMPRISING A BACK COATING CONTAINING STARCH, AN ACRYLATE COPOLYMER AND AN ALKALINE CATALYST

BACKGROUND OF THE INVENTION

1. Field of the Invention

The invention is directed to a heat-sensitive recording sheet with a substrate, having a front side and a back side, a heat-sensitive recording layer which is arranged on the front side and includes color formers and color developers, and a backcoat formed on the back side.

2. Description of the Prior Art

A prior art recording sheet is known from DE-C-38 36 660. A backcoat of this recording sheet may be formed of water-soluble high polymers such as starch, gelatins, styrene-maleic acid anhydride copolymer hydrolysates or polyvinyl alcohol and from water-insoluble polymers such as latices. The polymers may be used by themselves or in mixtures. When this known recording sheet is used as a label, the known backcoat is supposed to prevent the unwanted influence of plasticizers that are present on a sheet on which the label is to be affixed label.

In a multi-layer, thermally printable sheet with a heat-sensitive color-forming layer on the front side of the layer carrier according to DE-C-32 07 071, a prior art barrier layer comprising water-soluble polymers and a water-repellent wax or a wax-like compound are provided on the back side. The desired effect is the prevention of damaging influences, especially through plasticizers.

It was suggested in DE-A-35 29 781 to print on the coating carrier. In prior art reference order to be able to discern the printed pattern, either the heat-sensitive recording layer must be transparent or, when printing on the back of the layer carrier, the backcoat and the respective adhesive layer must be transparent. Despite the fact that the use of pigments such as those often employed for improving the suitability of the thermal head is accordingly ruled out, a complicated sequence of individual process steps is required in a disadvantageous manner because the printing process directly follows the generation of the coating base paper, and the printing process is then followed by the further coating and laminating steps.

U.S. Pat. No. 4,593,298 discloses another prior art backcoat which has an alkali salt of a styrene-maleic acid copolymer and a polymeric latex. The aim of the known backcoat is to improve resistance to water and resistance to blocking. At the same time, the runnability should be improved and the tendency of the paper to curl should be restricted.

EP-B-0 171 810 describes yet another prior art backcoat in which the stability of the recorded image is to be improved through the use of a polyurethane emulsion which is applied in a weight of 1 to 5 g/m$^2$ in that liquids such as plasticizers, oil, water and solvents are prevented from penetrating from the back into the color developing layer.

EP-A-0 518 552 describes a prior art heat-sensitive recording material in which the substrate is either a thermoplastic film or a synthetic paper. A coating layer applied to the back comprises at least 20% of a water-soluble polymer, e.g., polyvinyl alcohol, cellulose ether or starch. The backcoat preferably also contains water-insoluble polymers such as copolymers of vinyl acetate acrylic acid esters, methacrylic acid esters and acrylic acid esters, polyurethane resins, polyvinyl chloride resins and polyvinylidene chloride resins. The backcoat is supposed to prevent the curling which develops in the heat-sensitive recording layer. A cross-linking agent may also be added, if necessary, to improve the resistance of the backcoat to water.

Another prior art heat-sensitive recording material described in DE-A-37 20 171 which has a colored fluorescent dye composition in its recording layer is provided on the back side with a barrier layer which can be produced essentially from water-soluble polymer materials such as polyvinyl alcohol, various cellulose ethers, starches, gelatins, casein and polyvinylpyrolidone and resins dispersed in water, e.g., polystyrene emulsions. The function of the barrier layer is to protect against damaging materials such as oils and plasticizers which can lead to discoloration of the images developed in the recording layer.

DE-A-38 06 201 discloses a prior art heat-sensitive recording paper in which the paper carrier has a layer containing a cationic styrene/acrylic copolymer to prevent dust development and flocculation during calendering or super-calendering of paper. Further advantages consist in a broader contact surface with the thermal head during recording, a high recording density, an outstanding dot reproduction capacity, low fogging and low adhesion as well as prevention of soiling or discoloration at the thermal head. If required, the application of the cationic styrene/acrylic copolymers may be carried out in combination with starch, polyvinyl alcohol, a latex, pigment or dye by a size press or a coating device. This reference does not describe the suitability of the known heat-sensitive recording paper for producing labels whose back side is resistant to the influence of oils and/or plasticizers.

The surface sizing of coating base paper is provided according to JP-A-60-2397, wherein the coating base paper is used for producing heat-sensitive recording materials. Alternatively, it is suggested therein to provide a precoat beneath the heat-sensitive recording layer. In the case of surface sizing, a water-soluble copolymer can be used in addition to a styrene/methacrylate.

It has been shown in the past that the known measure of developing sufficient resistance to oils, fats, plasticizers and organic solvents are not adequate.

SUMMARY OF THE INVENTION

It is the object of the present invention to develop a heat-sensitive recording material with a backcoat which has a good barrier effect with respect to the substances used in offset printing and flexographic printing, especially organic solvents and with respect to plasticizers, oils and fats. Further, a sheet or web of this heat-sensitive recording material wound onto a roll is to be prevented from jamming or blocking in the roll.

This object is met in a heat-sensitive recording sheet with a substrate, a heat-sensitive recording layer arranged on a front side of the substrate including color formers and color developers, and a backcoat formed on a rear side of the substrate including in that the backcoat is formed of a mixture containing starch, an acrylate copolymer which does not comprise styrene or vinyl acetate components and has a film-forming temperature of less than 5° C., and an alkaline catalyst. The minimum film-forming temperature of the acrylate copolymer is preferably less than 2° C.

DETAILED DESCRIPTION OF THE PREFERRED EMBODIMENTS

A heat-sensitive recording sheet according to the present-invention including a substrate having a front side and a rear side. A heat-sensitive recording layer is arrange on the front side of the substrate and includes color formers and color developer. A backcoat is formed on the rear side of the substrate and includes a mixture containing starch, an acrylate copolymer which does not include styrene or vinyl acetate components, and an alkaline catalyst. The acrylate copolymer has a film forming temperature of less than 5° C. and is preferably less than 2° C.

The term acrylate copolymer used in the description and in the claims is meant comprise a copolymer formed of acrylate and/or methacrylate which does not comprise any styrene or vinyl acetate components. Although not required, the acrylate copolymer preferably has reactive groups.

The copolymer to be used according to the invention may comprise an aqueous dispersion or emulsion. The cross-linking of the acrylate copolymer is ensured through the use of an alkaline catalyst which counters the tendency of the paper web to block or jam.

Within the scope of the present invention, the term starches is meant to include not only starch itself but also starch derivatives such as starch ethers and starch esters.

The starches and the acrylate copolymer are preferably cationic components.

The substrate preferably comprises paper composed chiefly of cellulose fibers. In another preferred embodiment, the substrate; a paper whose fibrous material consists of wood-free cellulose fibers.

An excellent barrier effect of the backcoat is presumably explained by the film-forming characteristics of the acrylate copolymer which forms a relatively soft and slightly sticky film without the addition, according to the invention, of starch. It is further preferred that the backcoat contains 40 to 50 parts by weight of starch with respect to its total weight.

It is further preferred that the backcoat contains 30 to 40 parts by weight of acrylate copolymer with respect to its total weight.

It has proven particularly suitable that the backcoat contains, with respect to its total weight, 9 to 28 parts by weight, especially preferably 13 to 24 parts by weight, of the alkaline catalyst.

The alkaline catalysts may comprise metal carbonates such, for example, as calcium carbonate and magnesium carbonate A, precipitated calcium carbonate is a particularly preferred embodiment. Sodium carbonate, however, is unsuitable because the sodium ions can result in corrosion of the thermal head. Potassium compounds and chloride compounds are also unsuitable.

According to a further embodiment form, the backcoat may also contain a cross-linking agent, such as epichlorhydrine resin.

It has proven especially suitable to apply the backcoat to the substrate in a weight of 1 to 3 g/m$^2$, especially in the weight range of 1.5 to 2.5 g/m$^2$.

The use of a cationic starch and/or a catatonic acrylate copolymer for obtaining a backcoat according to the invention is not to be confused with the long-familiar use of cationic sizing agents such as those added to the fiber-mass for internal sizing or also applied, as the case may be, as surface sizing agents by size presses or other like devices. These known application methods do not lead to a tight film such as is generated by the backcoat provided according to the invention on a side of a paper web.

Whenever reference is made in the description and patent claims in the present application to parts by weight, this is to be understood as oven-dry parts by weight.

The present heat-sensitive recording paper according to the invention is used as labels in foodstuff packaging and is especially suitable for labeling deep-frozen foods with labels to be applied with special adhesives. When used for this purpose, the backcoat according to the invention prevents plasticizers from penetrating into the label, so that there is no discoloration or change in the text image generated on the front side in the heat-sensitive recording layer.

Further, it is also preferred that the heat-sensitive recording layer is covered with a protective layer.

Another area of use is the production of tickets with additional information printed on the back, but especially tickets of this type which have solvent-containing magnetic stripes printed on the back.

The following examples explain the invention.

EXAMPLE 1

An aqueous preparation of 47 parts by weight of cationic starch, 16 parts by weight of precipitated calcium carbonate and 37 parts by weight of a styrene or vinyl acetate component of free cationic acrylate copolymers was prepared. The preparation was adjusted to a solid content of 18 percent by weight—pH 7.5—and 2.2 g/m$^2$ of aqueous the preparation was applied to a coating base paper and dried. The other side of the coated web stock was provided with an intermediate layer serving to receive the heat-sensitive recording layer, the essential components of this intermediate layer being an oil-absorbing pigment and binder. The formed intermediate layer was subsequently provided with a conventional heat-sensitive recording layer.

EXAMPLE 2

Another preparation was prepared from the same components with 18 percent by weight solid content, wherein, however, 44 parts by weight of cationic starch, 34 parts by weight of an aqueous cationic acrylate polymer and 22 parts by weight of precipitated calcium carbonate were added.

What is claimed is:

1. A heat sensitive recording sheet, comprising:

a substrate comprising paper and having a front side and a rear side;

a heat sensitive recording layer arranged on said front side of said substrate, including color formers and color developers; and a backcoat formed on said rear side of said substrate comprising a mixture including a starch, an acrylate copolymer excluding styrene and vinyl acetate components, and an alkaline catalyst, said acrylate copolymer having a film-forming temperature of less than 5° C.

2. The heat sensitive recording sheet of claim 1, wherein one of said starch and said acrylate copolymer comprises a cationic component.

3. The heat-sensitive recording sheet of claim 1, wherein said back coat comprises an amount of said starch within a range including 40 to 50 percent by weight with respect to a total weight of said back coat.

4. The heat-sensitive recording sheet of claim 3, wherein said backcoat comprises an amount of said acrylate copolymer within a range including 30 to 40 percent by weight with respect to said total weight of said back coat.

5. The heat-sensitive recording sheet of claim 4, wherein said backcoat comprises an amount of said alkaline catalyst within a range including 9 to 28 percent by weight with respect to said total weight of said backcoat.

6. The heat-sensitive recording sheet of claim 4, wherein said backcoat comprises an amount of said alkaline catalyst within a range including 13 to 24 percent by weight with respect to said total weight of said backcoat.

7. The heat-sensitive recording sheet of claim 1, wherein said backcoat comprises an amount of said acrylate copolymer within a range including 30 to 40 percent by weight with respect to said total weight of said back coat.

8. The heat-sensitive recording sheet of claim 1, wherein said backcoat comprises an amount of said alkaline catalyst within a range including 9 to 28 percent by weight with respect to said total weight of said backcoat.

9. The heat-sensitive recording sheet of claim 1, wherein said backcoat comprises an amount of said alkaline catalyst within a range including 13 to 24 percent by weight with respect to said total weight of said backcoat.

10. The heat-sensitive recording sheet of claim 1, wherein said alkaline catalyst comprises a metal carbonate.

11. The heat-sensitive recording of claim 1, wherein said alkaline catalyst comprises calcium carbonate.

12. The heat-sensitive recording sheet of claim 1, wherein said alkaline catalyst comprises precipitated calcium carbonate.

13. The heat-sensitive recording sheet of claim 1, wherein said backcoat is applied to said substrate at a weight per area in the range including 1 to 3 $g/m^2$.

14. The heat-sensitive recording sheet of claim 1, further comprising a protective layer applied over said heat-sensitive recording layer.

* * * * *